US009117611B2

(12) United States Patent
Naka et al.

(10) Patent No.: US 9,117,611 B2
(45) Date of Patent: Aug. 25, 2015

(54) ELECTROMAGNETIC CONTACTOR

(75) Inventors: Yasuhiro Naka, Kounosu (JP); Kouetsu Takaya, Kounosu (JP); Kenji Suzuki, Kounosu (JP); Osamu Kashimura, Hino (JP)

(73) Assignees: FUJI ELECTRIC FA COMPONENTS & SYSTEMS CO., LTD., Tokyo (JP); FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/116,226

(22) PCT Filed: Apr. 3, 2012

(86) PCT No.: PCT/JP2012/002333

§ 371 (c)(1),
(2), (4) Date: Nov. 22, 2013

(87) PCT Pub. No.: WO2012/157176

PCT Pub. Date: Nov. 22, 2012

(65) Prior Publication Data

US 2014/0062627 A1 Mar. 6, 2014

(30) Foreign Application Priority Data

May 19, 2011 (JP) ..... 2011-112907

(51) Int. Cl.

| | |
|---|---|
| ***H01H 9/30*** | (2006.01) |
| ***H01H 50/54*** | (2006.01) |
| ***H01H 50/42*** | (2006.01) |
| *H01H 9/34* | (2006.01) |
| *H01H 50/02* | (2006.01) |
| *H01H 1/54* | (2006.01) |
| *H01H 9/44* | (2006.01) |

(52) U.S. Cl.

CPC ..... *H01H 50/54* (2013.01); *H01H 50/42* (2013.01); *H01H 50/546* (2013.01); *H01H 1/54* (2013.01); *H01H 9/34* (2013.01); *H01H 9/443* (2013.01); *H01H 2050/025* (2013.01)

(58) Field of Classification Search

CPC ..... H01H 50/42; H01H 50/546; H01H 50/54; H01H 9/34; H01H 1/54; H01H 9/443; H01H 2050/025

USPC ..... 335/78, 128, 189–191, 201, 202, 203

See application file for complete search history.

(56) References Cited

U.S. PATENT DOCUMENTS 3,465,270 A 9/1969 Schattler
5,546,061 A * 8/1996 Okabayashi et al. ..... 335/78

(Continued)

FOREIGN PATENT DOCUMENTS

JP H05-25644 U 4/1993
JP S62-140328 A 6/1997

OTHER PUBLICATIONS

Europe Patent Office, "Search Report for EP 12786354.6," Oct. 2, 2014.

*Primary Examiner* — Bernard Rojas
(74) *Attorney, Agent, or Firm* — Manabu Kanesaka

(57) ABSTRACT

An electromagnetic contactor has a contact device including a pair of fixed contacts disposed maintaining a predetermined distance and a movable contact disposed to be capable of contacting to and separating from the pair of fixed contacts. The pair of fixed contacts each includes a support conductor portion supported by an upper plate of a contact housing case, and a contact conductor portion connected to an end portion of the support conductor portion. The contact conductor portion includes a contact plate portion formed with a contact portion, and a connecting plate portion formed on an outer end portion of the contact plate portion and extending to the upper plate side. The movable contact is mounted onto a connecting shaft connected to a drive portion through a contact spring on an end portion on the upper plate side, and disposed to face the contact portion of the pair of fixed contacts.

6 Claims, 10 Drawing Sheets

(56) References Cited

U.S. PATENT DOCUMENTS 5,892,194 A * 4/1999 Uotome et al. ..... 218/68
8,823,472 B2 * 9/2014 Takaya et al. ..... 335/133
2005/0148216 A1 7/2005 Nishida et al.
2005/0151606 A1 * 7/2005 Nishida et al. ..... 335/128
2009/0237191 A1 9/2009 Yano et al.

* cited by examiner

ELECTROMAGNETIC CONTACTOR

RELATED APPLICATION

The present application is a National Phase of International Application No. PCT/JP2012/002333 filed Apr. 3, 2012, and claims priority from Japanese Applications No. 2011112907 filed May 19,2011.

TECHNICAL FIELD

The present invention relates to an electromagnetic contactor having a pair of fixed contacts disposed maintaining a predetermined interval and a movable contact disposed so as to be capable of contacting to and separating from the fixed contacts.

BACKGROUND ART

A fixed contact terminal support structure, having a fixed contact terminal support structure that supports a pair of fixed contact terminals, on free ends of which are provided fixed contacts, with a fixed contact stand and causes both end portions of a movable contact piece to be capable of contacting to and separating from the pair of fixed contacts, wherein the fixed contact terminals, to which a connection terminal is fixed by caulking, are formed in an approximate C-shape, and a permanent magnet is installed in a lower side corner portion of the fixed contact terminals, has been proposed as a contact structure that may be applied to an electromagnetic contactor that carries out switching of a current path (for example, refer to Patent Literature 1).

CITATION LIST

Patent Literature

PTL 1: JP-A-2005-183277

SUMMARY OF INVENTION

Technical Problem

However, the heretofore known example described in PTL 1 is such that, although the fixed contact terminals are formed in an approximate C-shape, the fixed contact terminals are formed in a C-shape in order to support a permanent magnet in a corner portion thereof, the height increases, and there is an unsolved problem in that it is not possible to reduce the size of the contact device when it is applied to an electromagnetic contactor.

Also, when adopting an engaged state wherein the movable contact contacts the fixed contacts and a current flows, an electromagnetic repulsion force is generated in a contact opening direction in portions in which the movable contact and fixed contacts are contacting when the current flowing is a large current, so that it is no longer possible to secure stable contact between the movable contact and fixed contacts, and there is an unsolved problem in that short circuit resistance performance decreases. There is also an unsolved problem in that there arises a need to increase the urging force of a contact spring that presses the movable contact to the fixed contact side in order to counter the electromagnetic repulsion force.

Therefore, the invention, having been contrived focusing on the heretofore described unsolved problems of the heretofore known example, has an object of providing an electromagnetic contactor such that it is possible to reduce the height of a contact device, thus reducing the size of the electromagnetic contactor, while suppressing electromagnetic repulsion force generated between a movable contact and fixed contacts.

Solution to Problem

In order to achieve the heretofore described object, an electromagnetic contactor according to one aspect of the invention includes a contact device including a pair of fixed contacts disposed maintaining a predetermined distance and a movable contact disposed to be capable of contacting to and separating from the pair of fixed contacts. The pair of fixed contacts include support conductor portions maintaining a predetermined interval and supported by an upper plate of a contact housing case, and a contact conductor portion connected to an end portion of the support conductor portion inside the contact housing case. The contact conductor portion has a contact plate portion formed with at least a contact portion on an upper plate side and in parallel with the upper plate, and a connecting plate portion formed in proximity to the contact portion on an outer end portion of the contact plate portion and extending to the upper plate side. The movable contact is mounted onto a connecting shaft connected to a drive portion through a contact spring on an end portion on the upper plate side, and disposed to face the contact portion of the pair of fixed contacts from the upper plate side.

According to this configuration, because the pair of fixed contacts have an L-shaped or C-shaped contact conductor portion wherein a contact plate portion having at least a contact portion is disposed parallel with the upper plate and a connecting plate portion is formed in proximity to the contact portion on an outer end portion of the contact plate portion and extending to the upper plate side, when adopting a conductive state by bringing both ends of the movable contact into contact with the contact portions of the pair of fixed contacts when engaging the electromagnetic contactor, it is possible to cause a magnetic field generated by the current flowing through the connecting plate portion to act on the upper plate side of the movable contact. Because of this, a Lorentz force pressing the movable contact to the fixed contact portion side is generated, contact between the movable contact and the contact portions of the fixed contacts is maintained, and it is thus possible to realize a high short circuit resistance performance. Consequently, it is possible to reduce the urging force of the contact spring that urges the movable contact to the fixed contact portion side and thus possible to suppress the height of the contact device.

Also, it is good when the electromagnetic contactor is such that the contact conductor portion is formed in a C-shape having a second connecting plate portion in parallel to the contact plate portion and disposed between an end portion of the connecting plate portion on the upper plate side and the support conductor portion.

According to this configuration, because the fixed contacts are formed in a C-shape portion, it is also possible to form a magnetic field on the upper plate side of the movable contact with the current flowing through the second connecting plate portion, and thus possible to increase the magnetic flux density on the upper plate side of the movable contact, generating a bigger Lorentz force countering the electromagnetic repulsion force.

Also, it is good when the electromagnetic contactor is such that the movable contact is formed with a depressed portion protruding toward the side opposite to that of the upper plate in a portion in which the movable contact comes into contact with the contact spring.

According to this configuration, because the contact spring contacts the depressed portion of the movable contact, it is possible to reduce the height of the upper plate of the contact spring by an amount equivalent to the size of the depressed portion, and thus possible to reduce the height of the whole contact device.

Advantageous Effects of Invention

According to the invention, it is possible to generate a Lorentz force that counters the electromagnetic repulsion force in an engaged state by forming the contact conductor portions of the fixed contacts in an L-shape or C-shape, in accordance with which it is possible to set the urging force of the contact spring to be small, and thus possible to reduce the size of the contact device configuration. Moreover, as the contact conductor portion is such that it is necessary to bring a plate portion into close proximity in order to generate a Lorentz force that counters the electromagnetic repulsion force, it is possible to reduce the size of the contact conductor portion configuration by this amount.

Furthermore, as the contact conductor portions of the pair of fixed contacts and the contact spring are disposed in parallel, it is possible to reduce the height of the contact device considerably in comparison with a case wherein the movable contact is disposed on the side opposite to that of the upper plate, and the contact spring and contact conductor portions are disposed in series.

DESCRIPTION OF EMBODIMENTS

Hereafter, a description will be given, based on the drawings, of embodiments of the invention.

Figure 1:
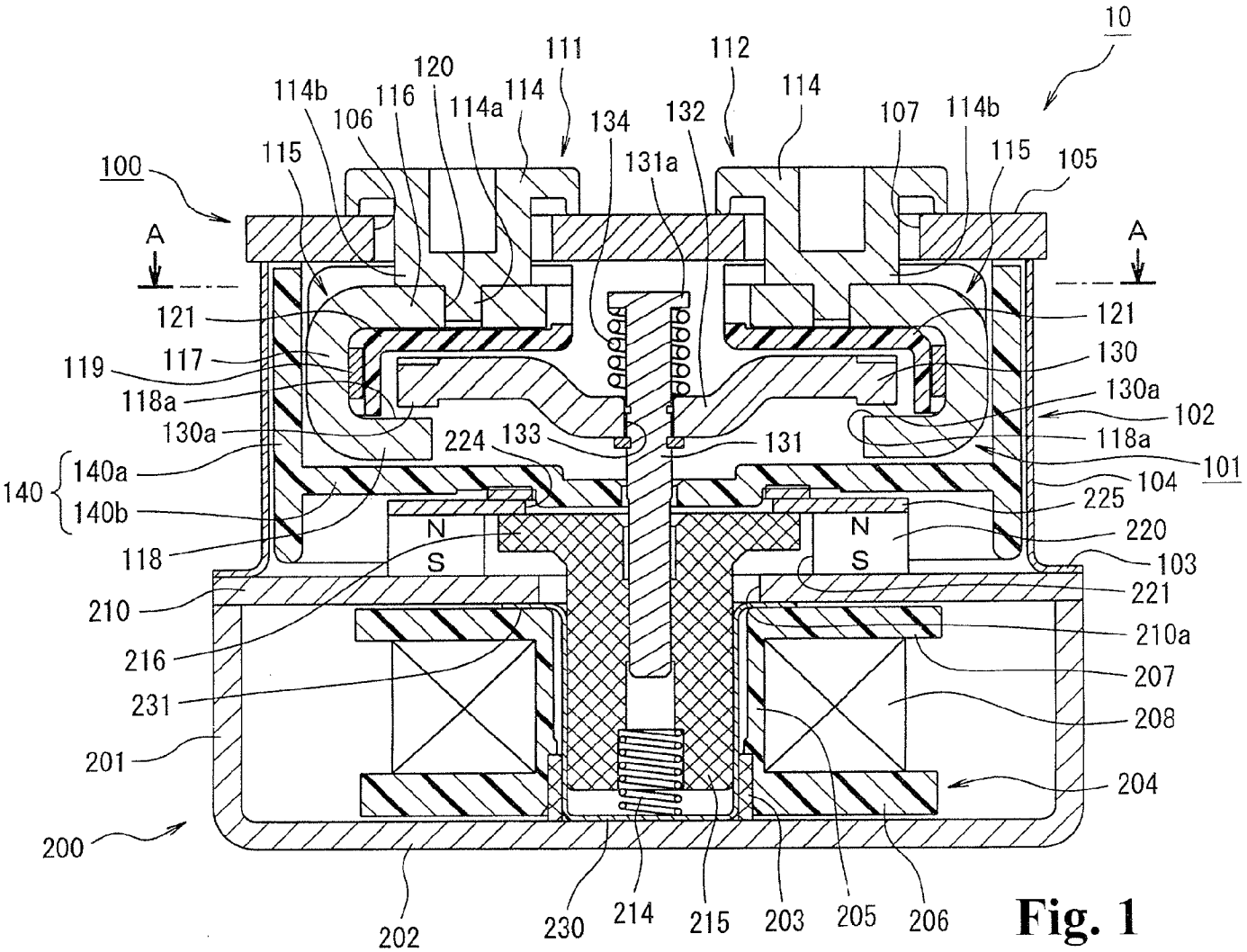
FIG. 1 is a sectional view showing a first embodiment of an electromagnetic contactor according to the present invention.
Figure 2B:
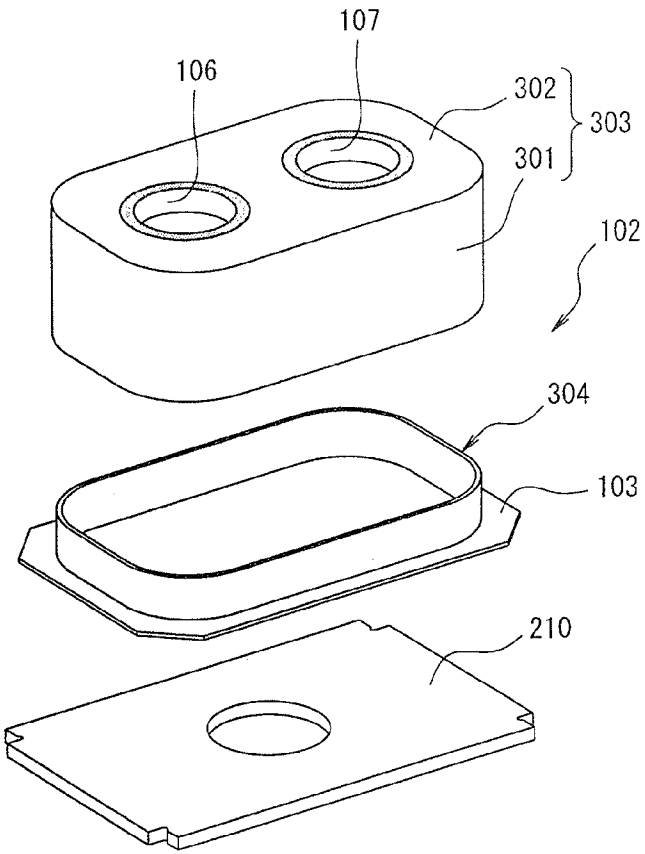
FIGS. 2(*a*), 2(*b*) are exploded perspective views of a contact housing case.
Figure 2A:
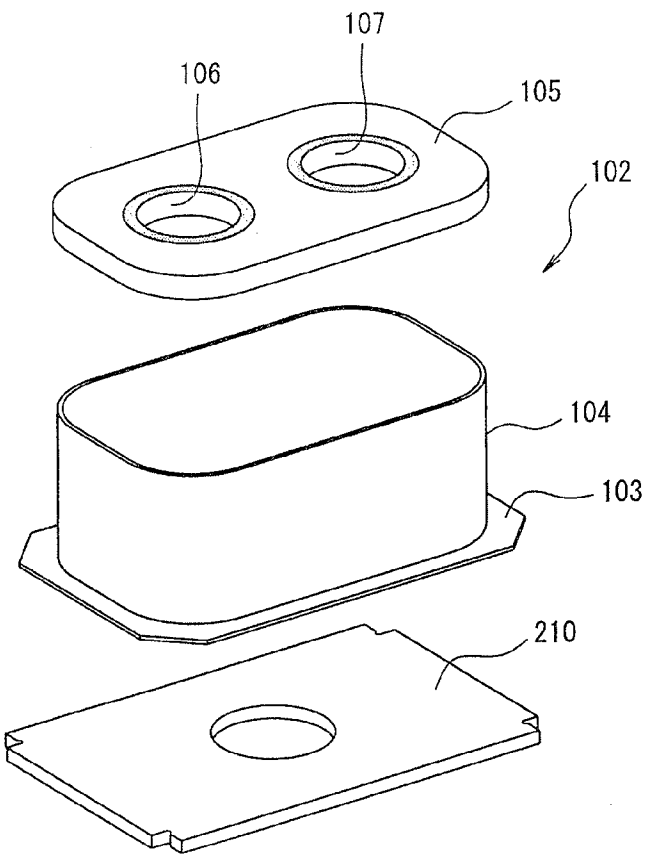

FIG. 1 is a sectional view showing one embodiment of an electromagnetic contactor according to the invention, while FIGS. 2(*a*), 2(*b*) are exploded perspective views of a contact housing case. In FIG. 1 and FIGS. 2(*a*), 2(*b*), numeral 10 is an electromagnetic contactor, and the electromagnetic contactor 10 is configured of a contact device 100 in which is disposed a contact mechanism, and an electromagnet unit 200 that drives the contact device 100.

The contact device 100 has a contact housing case 102 that houses a contact mechanism 101, as is clear from FIG. 1 and FIGS. 2(*a*), 2(*b*). The contact housing case 102 includes a metal tubular body 104 having on a lower end portion a metal flange portion 103 protruding outward, and a fixed contact support insulating substrate 105 configured of a plate-like ceramic insulating substrate that closes off the upper end of the metal tubular body 104, as shown in FIG. 2(*a*).

The metal tubular body 104 is such that the flange portion 103 thereof is seal joined and fixed to an upper portion magnetic yoke 210 of the electromagnet unit 200, to be described hereafter.

Also, through holes 106 and 107 in which are inserted a pair of fixed contacts 111 and 112, to be described hereafter, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts the tubular body 104. In order to carry out the metalizing process, copper foil is formed around the through holes 106 and 107, and in the position that contacts the tubular body 104, in a state wherein a plurality of the fixed contact support insulating substrates 105 is arranged vertically and horizontally on a flat surface.

The contact mechanism 101, as shown in FIG. 1, includes the pair of fixed contacts 111 and 112 inserted into and fixed in the through holes 106 and 107 of the fixed contact support insulating substrate 105 of the contact housing case 102. Each of the fixed contacts 111 and 112 includes a support conductor portion 114, having on an upper end a flange portion protruding outward, inserted into the through holes 106 and 107 of the fixed contact support insulating substrate 105, and a contact conductor portion 115, the inner side of which is opened, linked to the support conductor portion 114 and disposed on the lower surface side of the fixed contact support insulating substrate 105.

The contact conductor portion 115 includes an upper plate portion 116 as a second connecting plate portion extending to the outer side along the line of the lower surface of the fixed contact support insulating substrate 105, an intermediate plate portion 117 as a connection plate portion extending downward from the outer side end portion of the upper plate portion 116, and a lower plate portion 118 as a contact plate portion extending from the lower end side of the intermediate plate portion 117, parallel with the upper plate portion 116, to the inner side, that is, in a direction facing the fixed contacts 111 and 112. Because of this, the contact conductor portion 115 is formed in a C-shape wherein the upper plate portion 116 is added to an L-shape formed by the intermediate plate portion 117 and lower plate portion 118.

Herein, the support conductor portion 114 and contact conductor portion 115 are fixed by, for example, brazing in a state in which a pin 114*a* formed protruding on the lower end surface of the support conductor portion 114 is inserted into a through hole 120 formed in the upper plate portion 116 of the contact conductor portion 115. The fixing of the support conductor portion 114 and contact conductor portion 115, not being limited to brazing, may be such that the pin 114*a* is fitted into the through hole 120, or an external thread is formed on the pin 114*a* and an internal thread formed in the through hole 120, and the two are screwed together.

Also, a magnetic plate 119 of a C-shape when seen in plan view is mounted so as to cover the inner side surface of the intermediate plate portion 117 in the C-shaped portion 115 of the fixed contacts 111 and 112. By disposing the magnetic plate 119 so as to cover the inner side surface of the intermediate plate portion 117 in this way, it is possible to shield a magnetic field generated by current flowing through the intermediate plate portion 117.

Because of this, in the event that an arc is generated when, from a state in which contact portions 130*a* of a movable contact 130 are contacting contact portions 118*a* of the fixed contacts 111 and 112, the contact portions 130*a* move away upward, as will be described hereafter, it is possible to prevent interference between a magnetic field caused by the current flowing through the intermediate plate portion 117 and a magnetic field caused by the arc generated between the contact portions 118*a* of the fixed contacts 111 and 112 and the contact portions 130*a* of the movable contact 130. Consequently, it is possible to prevent the two magnetic fields from repelling each other, the arc being moved to the inner side along the line of the movable contact 130 by this electromagnetic repulsion force, and interruption of the arc becoming difficult. It being sufficient that it is possible to shield a magnetic field generated by current flowing through the intermediate plate portion 117, the magnetic plate 119 may be formed so as to cover the periphery of the intermediate plate portion 117.

Figure 3A:
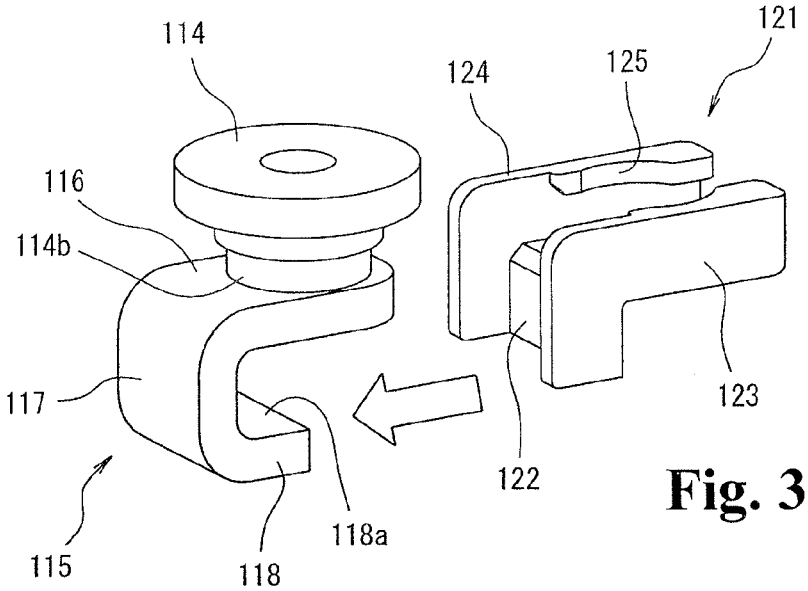
FIGS. 3(*a*)-3(*c*) are diagrams showing an insulating cover of a contact device, wherein FIG. 3(*a*) is a perspective view, FIG. 3(*b*) is a plan view before mounting, and FIG. 3(*c*) is a plan view after mounting.
Figure 3B:
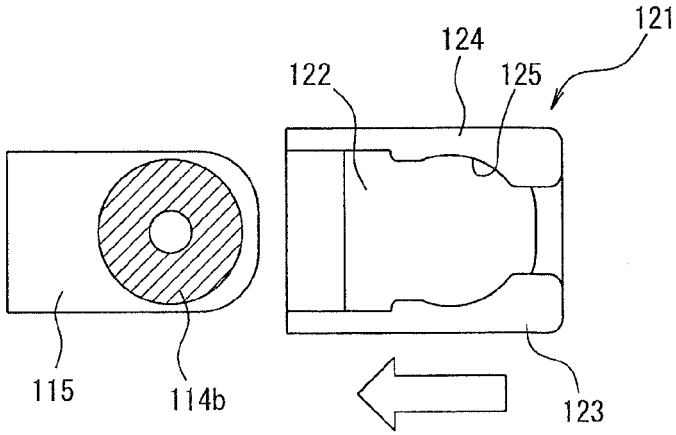
Figure 3C:
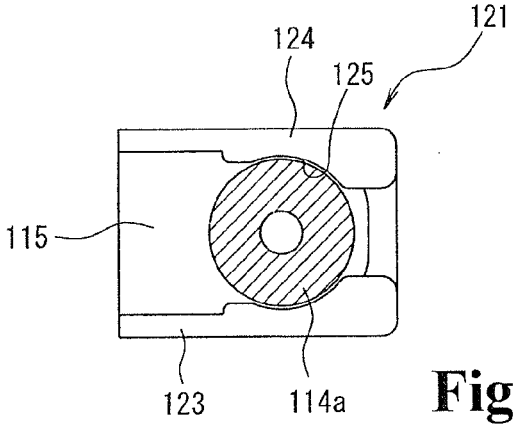

Furthermore, an insulating cover 121, made of a synthetic resin material, that regulates arc generation is mounted on the contact conductor portion 115 of each of the fixed contacts 111 and 112. The insulating cover 121 covers the inner peripheral surfaces of the upper plate portion 116 and intermediate plate portion 117 of the contact conductor portion 115, as shown in FIGS. 3(*a*) and 3(*b*). The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the contact conductor portion 115, and a fitting portion 125, formed on the inward side from the upper end of the side plate portions 123 and 124, that fits onto a small diameter portion 114*b* formed on the support conductor portion 114 of the fixed contacts 111 and 112.

Consequently, the insulating cover 121 is placed in a state in which the fitting portion 125 is facing the small diameter portion of the support conductor portion 114 of the fixed contacts 111 and 112, as shown in FIGS. 3(*a*) and 3(*b*), after which, the fitting portion 125 is fitted onto the small diameter portion 114*b* of the support conductor portion 114 by pushing the insulating cover 121 onto the small diameter portion 114*b*, as shown in FIG. 3(*c*).

Figure 4A:
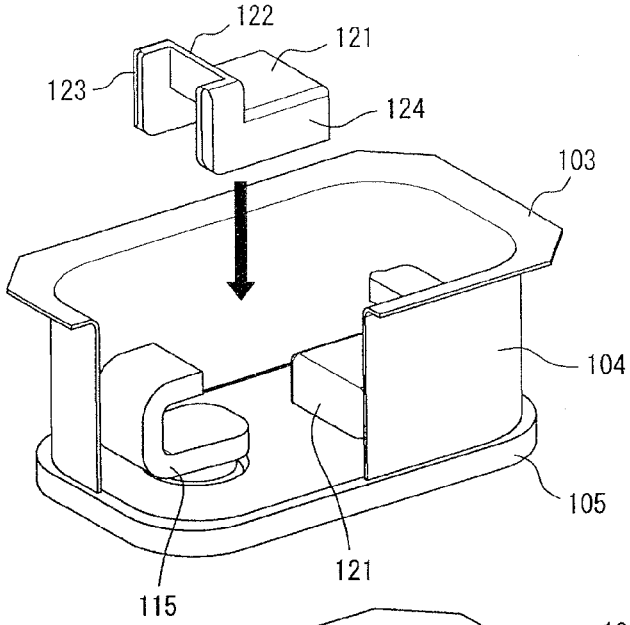
FIG. 4(*a*)-4(*c*) are illustrations showing an insulating cover mounting method.
Figure 4B:
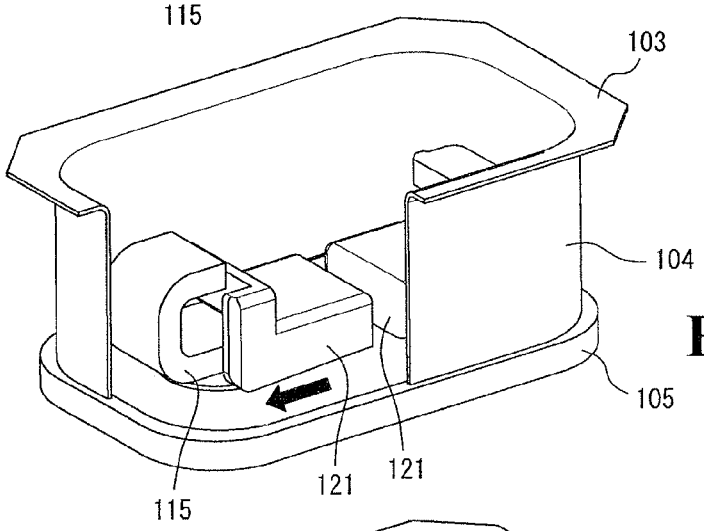
Figure 4C:
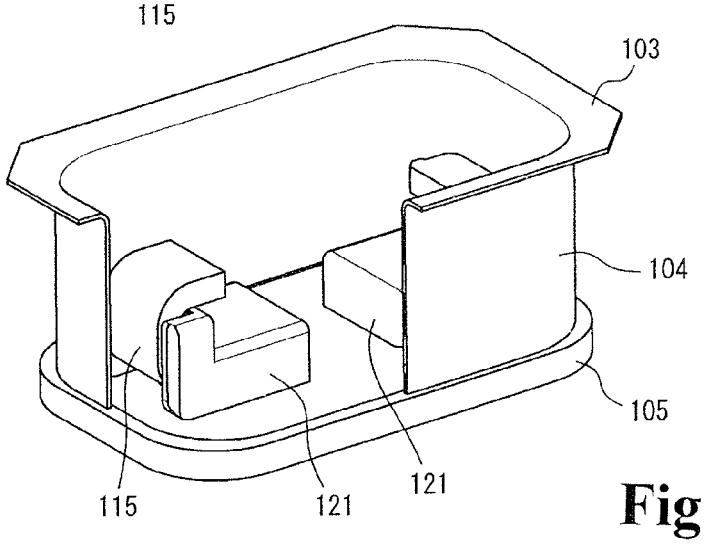

Actually, with the contact housing case 102 after the fixed contacts 111 and 112 have been attached in a state wherein the fixed contact support insulating substrate 105 is on the lower side, the insulating cover 121 is inserted from an upper aperture portion between the fixed contacts 111 and 112 in a state vertically the reverse of that in FIGS. 3(*a*) to 3(*c*), as shown in FIG. 4(*a*).

Next, in a state in which the fitting portion 125 is contacting the fixed contact support insulating substrate 105, as shown in FIG. 4(*b*), the fitting portion 125 is engaged with and fixed to the small diameter portion 114*b* of the support conductor portion 114 of the fixed contacts 111 and 112 by pushing the insulating cover 121 to the outer side, as shown in FIG. 4(*c*).

By mounting the insulating cover 121 on the contact conductor portion 115 of the fixed contacts 111 and 112 in this way, only the upper surface side of the lower plate portion 118 of the inner peripheral surface of the contact conductor portion 115 is exposed, and is taken to be the contact portion 118*a*.

Further, the movable contact 130 is disposed in such a way that both end portions are disposed in the contact conductor portion 115 of the fixed contacts 111 and 112. The movable contact 130 is supported by a connecting shaft 131 fixed to a movable plunger 215 of the electromagnet unit 200, to be described hereafter. The movable contact 130 is such that, as shown in FIG. 1, a central portion in the vicinity of the connecting shaft 131 protrudes downward, whereby a depressed portion 132 is formed, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*, and the moving contact 130 is positioned using, for example, a C-ring 135 so as to obtain a predetermined urging force from the contact spring 134.

The movable contact 130, in a released state, takes on a state wherein the contact portions 130*a* at either end and the contact portions 118*a* of the lower plate portions 118 of the contact conductor portions 115 of the fixed contacts 111 and 112 are separated from each other and maintaining a predetermined interval. Also, the movable contact 130 is set so that, in an engaged position, the contact portions at either end contact the contact portions 118*a* of the lower plate portions 118 of the contact conductor portions 115 of the fixed contacts 111 and 112 at a predetermined contact pressure due to the contact spring 134.

Furthermore, an insulating cylinder 140 formed in a bottomed tubular form of a bottom plate portion 140*a* and a tubular body 140*b* formed on the upper surface of the bottom plate portion 140*a* is disposed on the inner peripheral surface of the tubular body 104 of the contact housing case 102, as shown in FIG. 1. The insulating cylinder 140 is made of, for example, a synthetic resin, and the bottom plate portion 140*a* and tubular body 140*b* are formed integrally. Magnet housing cylinders 141 and 142 are formed integrally as magnet housing portions in positions on the insulating cylinder 140 facing the side surfaces of the movable contact 130. Arc extinguishing permanent magnets 143 and 144 are inserted into and fixed in the magnet housing cylinders 141 and 142.

Figure 5:
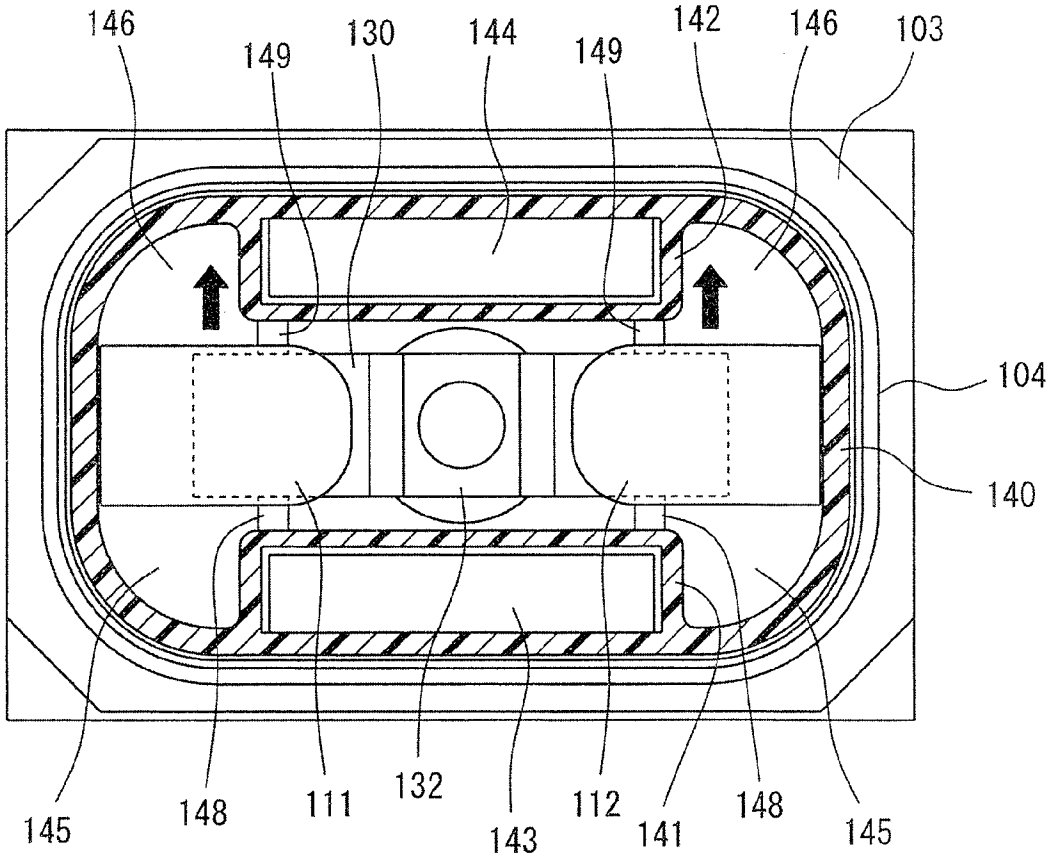
FIG. 5 is a sectional view along the line A-A in FIG. L

The arc extinguishing permanent magnets 143 and 144 are magnetized in a thickness direction so that mutually opposing faces thereof are homopolar, for example, N-poles. Also, the arc extinguishing permanent magnets 143 and 144 are set so that both end portions in a left-right direction are slightly inward of positions in which the contact portions 118*a* of the fixed contacts 111 and 112 and the contact portions of the movable contact 130 are opposed, as shown in FIG. 5. Further, arc extinguishing spaces 145 and 146 are formed on the outer sides in a left-right direction, that is, the longitudinal direction of the movable contact, of the magnet housing cylinders 141 and 142 respectively.

Also, movable contact guide members 148 and 149, which regulate the turning of the movable contact 130, are formed protruding, sliding against side edges of the magnet housing cylinders 141 and 142 toward either end of the movable contact 130.

Consequently, the insulating cylinder 140 includes a function of positioning the arc extinguishing permanent magnets 143 and 144 using the magnet housing cylinders 141 and 142, a protective function protecting the arc extinguishing permanent magnets 143 and 144 from an arc, and an insulating function preventing the arc from affecting the metal tubular body 104, which increases external rigidity.

Further, by disposing the arc extinguishing permanent magnets 143 and 144 on the inner peripheral surface side of the insulating cylinder 140, it is possible to bring the arc extinguishing permanent magnets 143 and 144 near to the movable contact 130. Because of this, as shown in FIG. 6(*a*), magnetic flux ϕ emanating from the N-pole sides of the two arc extinguishing permanent magnets 143 and 144 crosses portions in which the contact portions 118*a* of the fixed contacts 111 and 112 and the contact portions 130*a* of the movable contact 130 are opposed in a left-right direction, from the inner side to the outer side, with a large flux density.

Figure 6A:
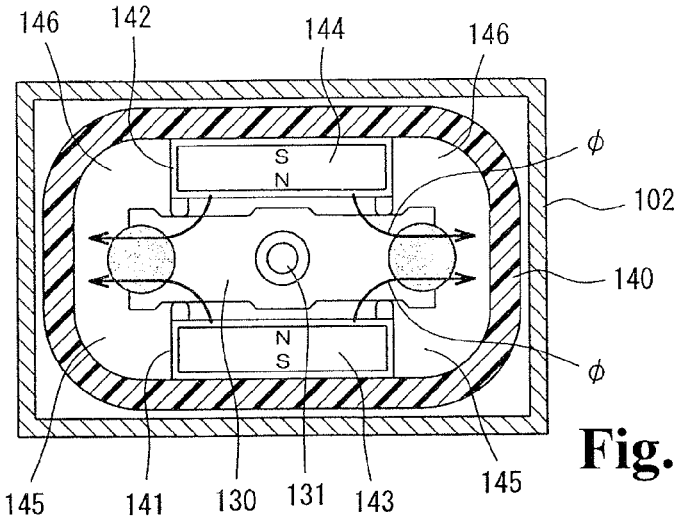
FIGS.6(*a*)-6(*c*) are illustrated accompanying a description of arc extinguishing by an arc extinguishing permanent magnet according to the invention.
Figure 6B:
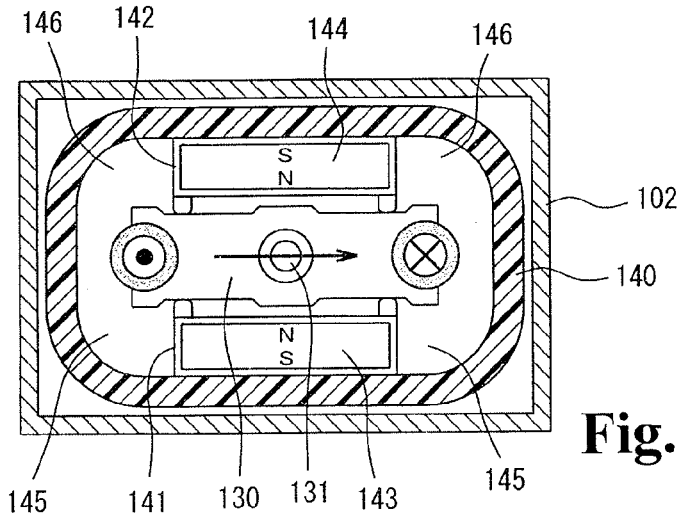
Figure 6C:
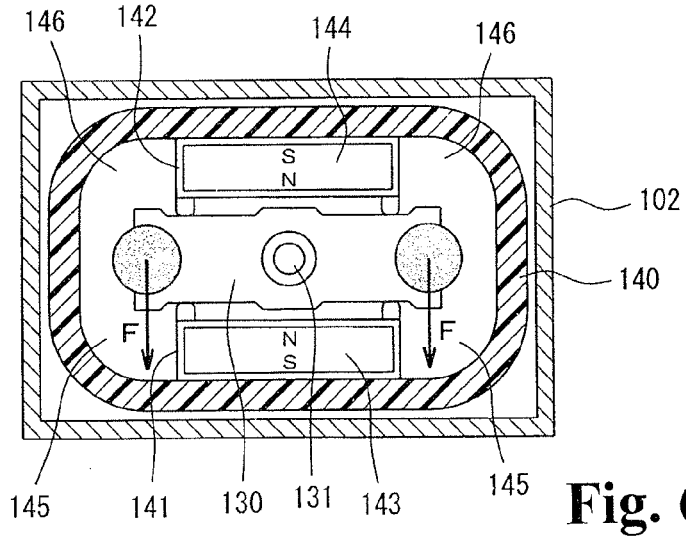

Consequently, assuming that the fixed contact 111 is connected to a current supply source and the fixed contact 112 is connected to a load side, the current direction in the engaged state is such that the current flows from the fixed contact 111 through the movable contact 130 to the fixed contact 112, as shown in FIG. 6(*b*). Then, when changing from the engaged state to the released state by causing the movable contact 130 to move away upward from the fixed contacts 111 and 112, an arc is generated between the contact portions 118*a* of the fixed contacts 111 and 112 and the contact portions 130*a* of the movable contact 130.

The arc is extended to the arc extinguishing space 145 side on the arc extinguishing permanent magnet 143 side by the magnetic flux ϕ from the arc extinguishing permanent magnets 143 and 144. At this time, as the arc extinguishing spaces 145 and 146 are formed as widely as the thickness of the arc extinguishing permanent magnets 143 and 144, it is possible to obtain a long arc length, and thus possible to reliably extinguish the arc.

Figure 7A:
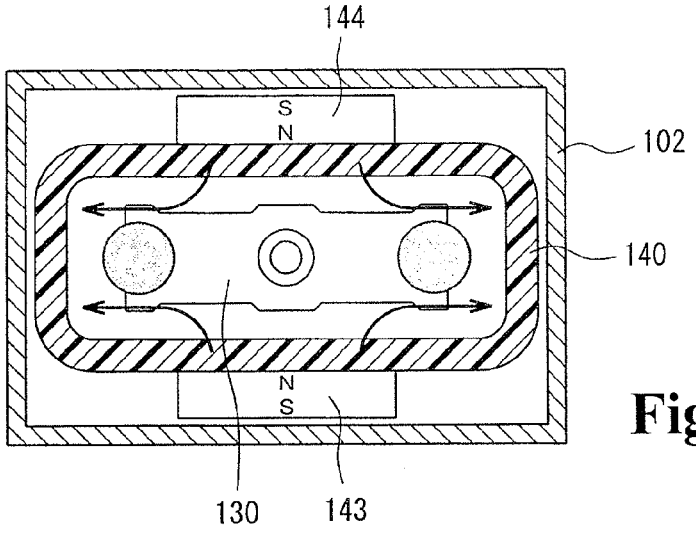
FIGS. 7(*a*)-7(*c*) are illustrations accompanying a description of arc extinguishing when the arc extinguishing permanent magnet is disposed on the outer side of an insulating case.
Figure 7B:
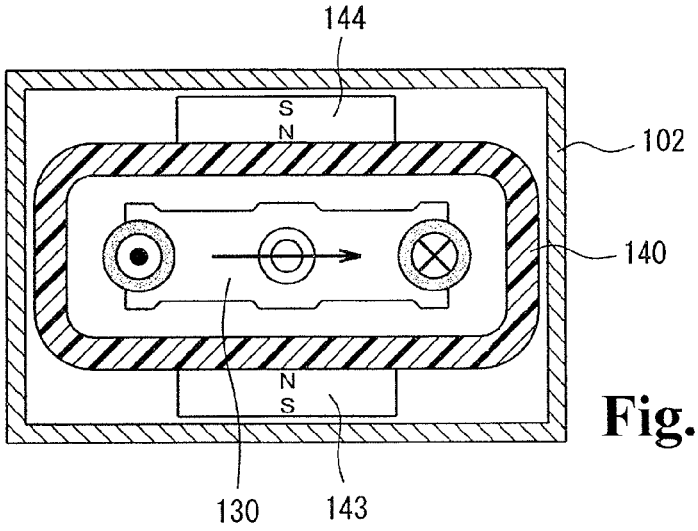
Figure 7C:
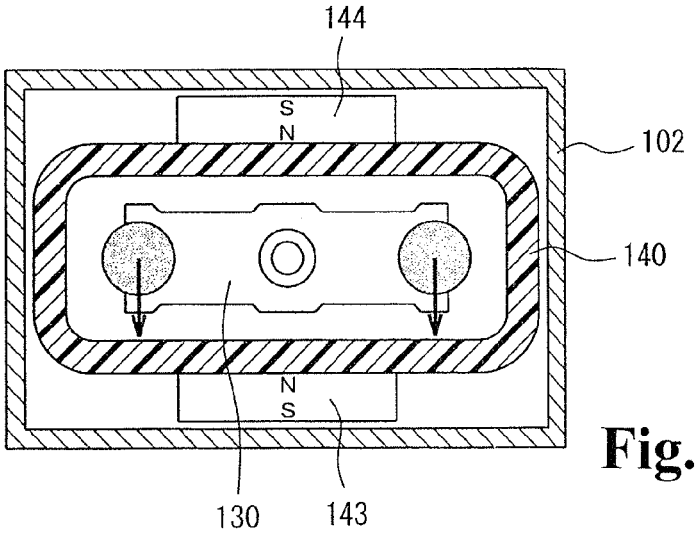

Incidentally, when the arc extinguishing permanent magnets 143 and 144 are disposed on the outer side of the insulating cylinder 140, as shown in FIGS. 7(*a*) to 7(*c*), there is an increase in the distance to the positions in which the contact portions 118*a* of the fixed contacts 111 and 112 and the contact portions 130*a* of the movable contact 130 are opposed, and when the same permanent magnets as in this embodiment are applied, the density of the magnetic flux crossing the arc decreases.

Because of this, the Lorentz force acting on an arc generated when shifting from the engaged state to the released state decreases, and it is no longer possible to sufficiently extend the arc. In order to improve the arc extinguishing performance, it is necessary to increase the magnetic force of the arc extinguishing permanent magnets 143 and 144. Moreover, in order to shorten the distance between the arc extinguishing permanent magnets 143 and 144 and the contact portions of the fixed contacts 111 and 112 and movable contact 130, it is necessary to reduce the depth in a front-back direction of the insulating cylinder 140, and there is a problem in that it is not possible to secure sufficient arc extinguishing space to extinguish the arc.

However, according to the heretofore described embodiment, the arc extinguishing permanent magnets 143 and 144 are disposed on the inner side of the insulating cylinder 140, because of which the problems occurring when the arc extinguishing permanent magnets 143 and 144 are disposed on the outer side of the insulating cylinder 140 can all be solved.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, a permanent magnet 220 formed in an annular shape, whose external form is, for example, rectangular and which has a circular central aperture 221 is fixed to the upper surface of the upper magnetic yoke 210 so as to enclose the peripheral flange portion 216 of the movable plunger 215. The permanent magnet 220 is magnetized in an up-down direction, that is, a thickness direction, so that the upper end side is, for example, an N-pole while the lower end side is an S-pole.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 contacts the lower surface of the auxiliary yoke 225.

The form of the permanent magnet 220 not being limited to that heretofore described, it can also be formed in a circular ring form, and in fact, the external form can be any form, such as circular or polygonal, provided that the inner peripheral surface is of a form tailored to the form of the peripheral flange portion 216.

Also, the connecting shaft 131 that supports the movable contact 130 is screwed to the upper end surface of the movable plunger 215.

Further, the movable plunger 215 is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this state, the exciting coil 208 in the electromagnet unit 200 is in a non-excited state, and there exists a released state wherein no exciting force causing the movable plunger 215 to descend is being generated in the electromagnet unit 200. In this released state, the movable plunger 215 is urged in an upward direction away from the upper magnetic yoke 210 by the return spring 214. Simultaneously with this, a suctioning force caused by the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the auxiliary yoke 225.

Because of this, the contact portions 130*a* of the movable contact 130 in the contact mechanism 101 connected to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted state, and the contact mechanism 101 is in a state wherein the contacts are opened.

In this way, as the urging force of the return spring 214 and the suctioning force of the annular permanent magnet 220 both act on the movable plunger 215 in the released state, there is no unplanned downward movement of the movable plunger 215 due to external vibration, shock, or the like, and it is thus possible to reliably prevent malfunction.

On the exciting coil 208 of the electromagnet unit 200 being excited in the released state, an exciting force is generated in the electromagnet unit 200, and the movable plunger 215 is caused to descend against the urging force of the return spring 214 and the suctioning force of the annular permanent magnet 220. The descent of the movable plunger 215 is stopped by the lower surface of the peripheral flange portion 216 contacting the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 contact the contact portions 118*a* of the fixed contacts 111 and 112 with the contact pressure of the contact spring 134.

Because of this, there exists a closed contact state wherein the large current of the external power supply source is supplied via the fixed contact. 111, movable contact 130, and fixed contact 112 to the load.

At this time, an electromagnetic repulsion force is generated between the fixed contacts 111 and 112 and the movable contact 130 in a direction such as to cause the contacts of the movable contact 130 to open.

However, as the fixed contacts 111 and 112 are such that the contact conductor portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions. Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, and possible to reduce the size of the contact spring 134, and thus possible to reduce the size of the contact device 100.

When interrupting the supply of current to the load in the closed contact state of the contact mechanism 101, the exciting of the exciting coil 208 of the electromagnet unit 200 is stopped.

By so doing, the exciting force causing the movable plunger 215 to move downward in the electromagnet unit 200 stops, the movable plunger 215 is raised by the urging force of the return spring 214, and the suctioning force of the annular permanent magnet 220 increases as the peripheral flange portion 216 nears the auxiliary yoke 225.

As the movable plunger 215 rises, the movable contact 130 connected via the connecting shaft 131 rises. As a result of this, the movable contact 130 is contacting the fixed contacts 111 and 112 as long as contact pressure is applied by the contact spring 134. Subsequently, it starts an opened contact state, wherein the movable contact 130 moves upward away from the fixed contacts 111 and 112 at the point at which the contact pressure of the contact spring 134 stops.

On the opened contact state starting, an arc is generated between the contact portions 118*a* of the fixed contacts 111 and 112 and the contact portions 130*a* of the movable contact 130, and the state in which current is conducted continues due to the arc. At this time, as the insulating cover 121 is mounted covering the upper plate portion 116 and intermediate plate portion 117 of the contact conductor portion 115 of the fixed contacts 111 and 112, it is possible to cause the arc to be generated only between the contact portions 118*a* of the fixed contacts 111 and 112 and the contact portions 130*a* of the movable contact 130. Because of this, it is possible to reliably prevent the arc from moving above the contact conductor portion 115 of the fixed contacts 111 and 112, thereby stabilizing the arc generation state, and thus possible to improve arc extinguishing performance. Moreover, as both side surfaces of the fixed contacts 111 and 112 are also covered by the insulating cover 121, it is also possible to reliably prevent the leading edge of the arc from short circuiting.

Furthermore, as the surfaces of the fixed contacts 111 and 112 facing the upper plate portion 116 and intermediate plate portion 117 of the contact conductor portion 115 are covered by the insulating cover 121, it is possible to bring the upper plate portion 116 and intermediate plate portion 117 and the movable contact 130 close together while maintaining the necessary insulating distance, and thus possible to reduce the height of the contact mechanism 101, that is, the height in the direction in which the movable contact 130 can move.

Further, as the insulating cover 121 can be mounted on the fixed contacts 111 and 112 simply by the fitting portion 125 being fitted onto the small diameter portion 114*h* of the fixed contacts 111 and 112, it is possible to easily carry out the mounting of the insulating cover 121 on the fixed contacts 111 and 112.

Furthermore, as the inner surface of the intermediate plate portion 117 of the fixed contacts 111 and 112 is covered by the magnetic plate 119, a magnetic field generated by current flowing through the intermediate plate portion 117 is shielded by the magnetic plate 119. Because of this, there is no interference between a magnetic field caused by the arc generated between the contact portions 118*a* of the fixed contacts 111 and 112 and the contact portions 130*a* of the movable contact 130 and the magnetic field caused by the current flowing through the intermediate plate portion 117, and it is thus possible to prevent the arc being affected by the magnetic field generated by the current flowing through the intermediate plate portion 117.

At this time, as the opposing magnetic pole faces of the arc extinguishing permanent magnets 143 and 144 are N-poles, and the outer sides thereof are S-poles, magnetic flux emanating from the N-poles, seen in plan view as shown in FIG. 6(*a*), crosses an arc generation portion of a portion in which the contact portion 118*a* of the arc extinguishing permanent magnets 143 and 144 fixed contact 111 and the contact portion 130*a* of the movable contact 130 are opposed, from the inner side to the outer side in the longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing magnets 143 and 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through the inside of the arc extinguishing space 145, reaching the upper surface side of the movable contact 130, and is extinguished.

Also, at the lower side and upper side of the arc extinguishing space 145, magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, the current I flows from the movable contact 130 side to the fixed contact 112 side between the contact portion 118*a* of the fixed contact 112 and the movable contact 130, and the orientation of the magnetic flux $\phi$ is in a rightward direction from the inner side toward the outer side, as shown in FIG. 6(*b*). Because of this, in accordance with Fleming's left-hand rule, a large Lorentz force F acts toward the arc extinguishing space 145 side, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through the inside of the arc extinguishing space 145, reaching the side surface side of the fixed contact 112, and is extinguished.

Also, at the lower side and upper side of the arc extinguishing space 145, as heretofore described, magnetic flux inclines to the lower side and upper side with respect to the orientation of the magnetic flux between the contact portion 118*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, in the engaged state of the electromagnetic contactor 10, when adopting a released state in a state wherein a regenerative current flows from the load side to the direct current power source side, the direction of current in FIG. 6(*b*) is reversed, meaning that the Lorentz force F acts on the arc extinguishing space 146 side, and except that the arc is extended to the arc extinguishing space 146 side, the same arc extinguishing function is fulfilled.

At this time, as the arc extinguishing permanent magnets 143 and 144 are disposed in the magnet housing cylinders 141 and 142 formed in the insulating cylinder 140, the arc does not directly contact the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal tubular body 104 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, the function of protecting the arc extinguishing permanent magnets 143 and 144 from the arc, and the insulating function preventing the arc from reaching the external metal tubular body 104 with the one insulating cylinder 140, it is possible to reduce manufacturing cost.

Also, as the movable contact guide members 148 and 149 that slide against a side edge of the movable contact are formed protruding on the permanent magnet housing cylinders 141 and 142 housing the arc extinguishing permanent magnets 143 and 144 in positions facing the movable contact 130, it is possible to reliably prevent turning of the movable contact 130.

Also, as it is possible to increase the distance between the side edges of the movable contact 130 and the inner peripheral surface of the insulating cylinder 140 by the thickness of the arc extinguishing permanent magnets 143 and 144, it is possible to provide sufficient arc extinguishing spaces 145 and 146, and thus possible to reliably carry out arc extinguishing.

Furthermore, as the movable contact guide members 148 and 149 that slide against a side edge of the movable contact are formed protruding on the magnet housing cylinders 141 and 142 housing the arc extinguishing permanent magnets 143 and 144 in positions opposing the movable contact 130, it is possible to reliably prevent turning of the movable contact 130.

In this way, according to the embodiment, a C-shape is adopted for the contact conductor portions 115 of the pair of fixed contacts 111 and 112, the intermediate plate portion 117 and upper plate portion 116 are disposed in proximity to the contact portions 118*a* so as to generate a Lorentz force opposing the electromagnetic repulsion force in the engaged state, and furthermore, the contact conductor portions 115 of the pair of fixed contacts 111 and 112 and the contact spring 134 are disposed in a parallel state in the extension direction of the movable contact 130, because of which it is possible to reduce the height of the contact device 100, and also possible to reduce the width, and thus possible to reduce the size of the whole contact device 100. Moreover, it is possible to generate a Lorentz force opposing the electromagnetic repulsion force generated when engaging in the contact conductor portions 115 of the fixed contacts 111 and 112 between the contact portions 118*a* of the fixed contacts 111 and 112 and the contact portions 130*a* of the movable contact 130. Because of this, it is possible to reduce the urging force of the contact spring 134, thus reducing the size thereof, and possible to reduce the height of the contact device 100 by this amount. Furthermore, the depressed portion 132 protruding on the side opposite to that of the fixed contact support insulating substrate 105 forming an upper plate, that is, the lower side, is formed in the position in which the movable contact 130 contacts the contact spring 134, because of which it is possible to further reduce the protruding height of the contact spring 134.

Incidentally, when omitting the contact conductor portion 115, forming a contact portion on the lower end of the support conductor portion 114, and disposing the movable contact 130 so as to be capable of contacting to and separating from the contact portion from below, the contact spring, movable contact, and fixed contacts are disposed in series in a vertical direction, and the height of the contact device 100 increases.

Figure 8:
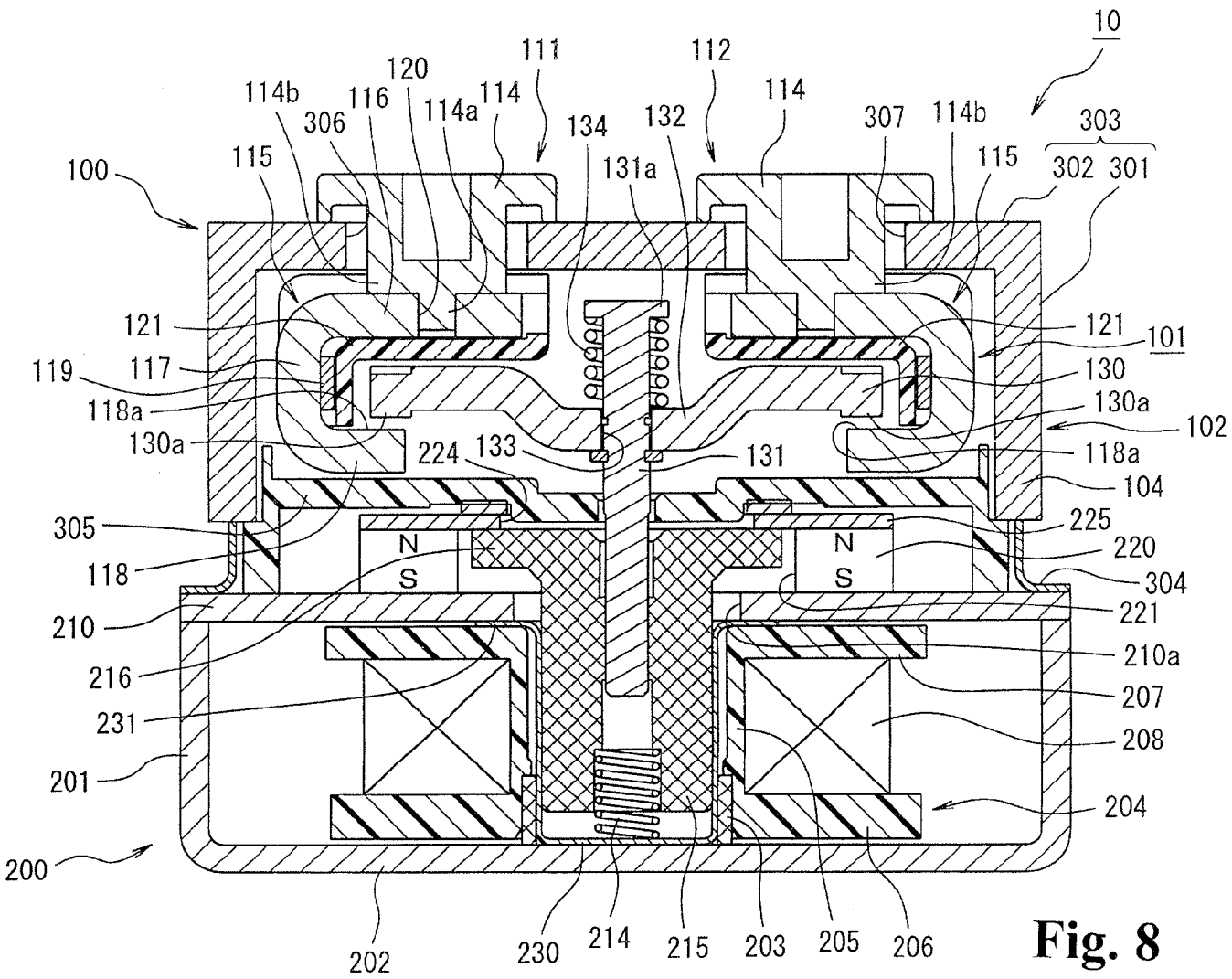
FIG. 8 is a sectional view showing a second embodiment of an electromagnetic contactor according to the invention.

Next, a description will be given of a second embodiment of the invention, based on FIG. 8.

In the second embodiment, the configuration of the contact housing case is changed.

Figure 10A:
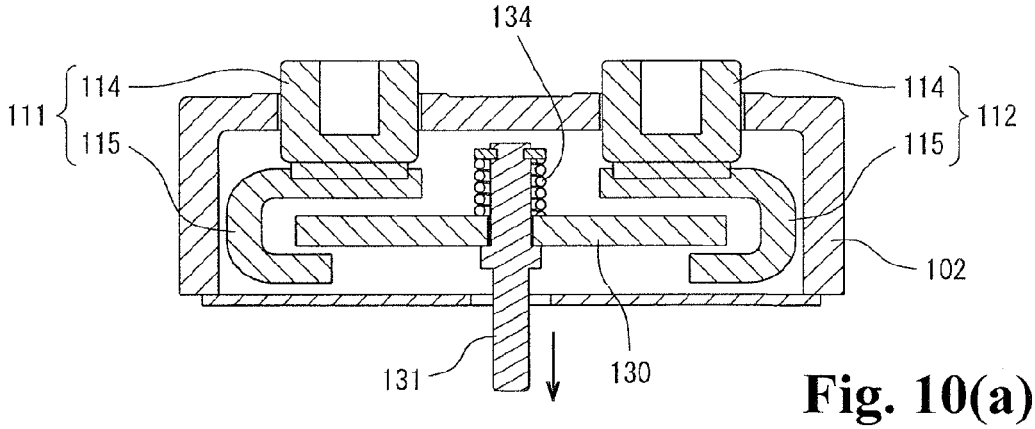
FIGS. 10(*a*), 10(*b*) are diagrams showing another modification example of a contact device of the invention, wherein FIG. 10(*a*) is a sectional view and FIG. 10(*b*) is a perspective view.
Figure 10B:
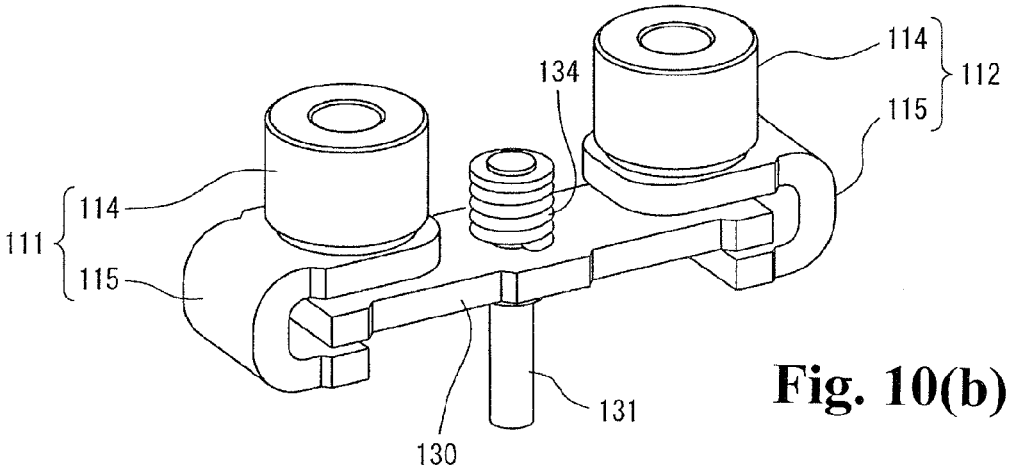

That is, in the second embodiment, the contact housing case 102 is configured of a tubular portion 301 and an upper surface plate portion 302 closing off the upper end of the tubular portion 301 being formed integrally of a ceramic or a synthetic resin material, thereby forming a tub-form body 303, a metal foil being formed on an opened end surface side of the tub-form body 303 by a metalizing process, and a metal connection member 304 being seal joined to the metal foil, as shown in FIG. 10 and FIG. 2(*b*).

Further, a bottom plate portion 305 formed of, for example, a synthetic resin, corresponding to the bottom plate portion 104*b* in the first embodiment, is disposed on the inner peripheral surface on the bottom surface side of the tub-form body 303.

Also, insertion holes 306 and 307 in which are inserted the fixed contacts 111 and 112 are formed in the upper surface plate portion 302, in the same way as in the fixed contact support insulating substrate 105, and the fixed contacts 111 and 112 are supported by the insertion holes 306 and 307, in the same way as in the first embodiment.

Configurations other than this have the same configurations as in the first embodiment, the same reference signs are given to portions corresponding to those in FIG. 1, and a detailed description thereof will be omitted.

According to the second embodiment, the contact housing case 102 is configured of the tub-form body 303 integrally molded of an insulating material, because of which it is possible to easily form the airtight contact housing case 102 in a small number of man-hours, and possible to reduce the number of parts.

In the first and second embodiments, a description has been given of a case wherein the opposing magnetic pole faces of the arc extinguishing permanent magnets 143 and 144 are N-poles but, not being limited to this, it is also possible to obtain the same advantages as in the heretofore described embodiments when arranging so that the opposing magnetic pole faces of the arc extinguishing permanent magnets 143 and 144 are S-poles, excepting that the direction in which the magnetic flux crosses the arc and the direction of the Lorentz force are reversed.

Also, in the first and second embodiments, a description has been given of a case wherein the contact housing case 102 is formed by brazing the metal tubular body 104 and the fixed contact support insulating substrate 105 that closes off the upper end of the tubular body 104, but not being limited to this. That is, the contact housing case 102 may be integrally formed in a tub-form of an insulating material, such as a ceramic or a synthetic resin material.

Figure 9A:
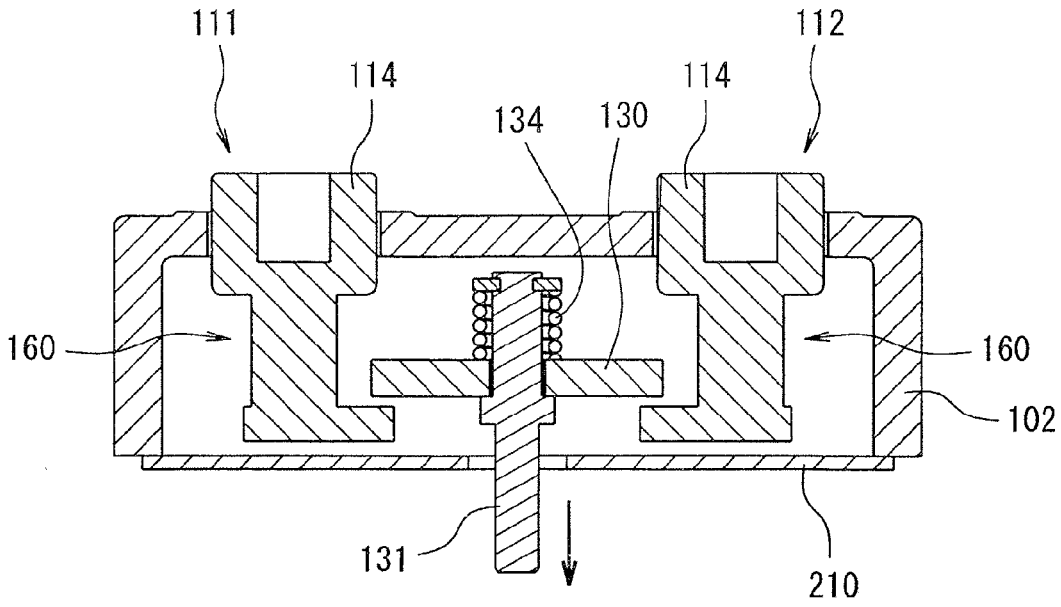
FIGS. 9(*a*), 9(*b*) are diagrams showing a modification example of a contact device of the invention, wherein FIG. 9(*a*) is a sectional view and FIG. 9(*b*) is a perspective view.
Figure 9B:
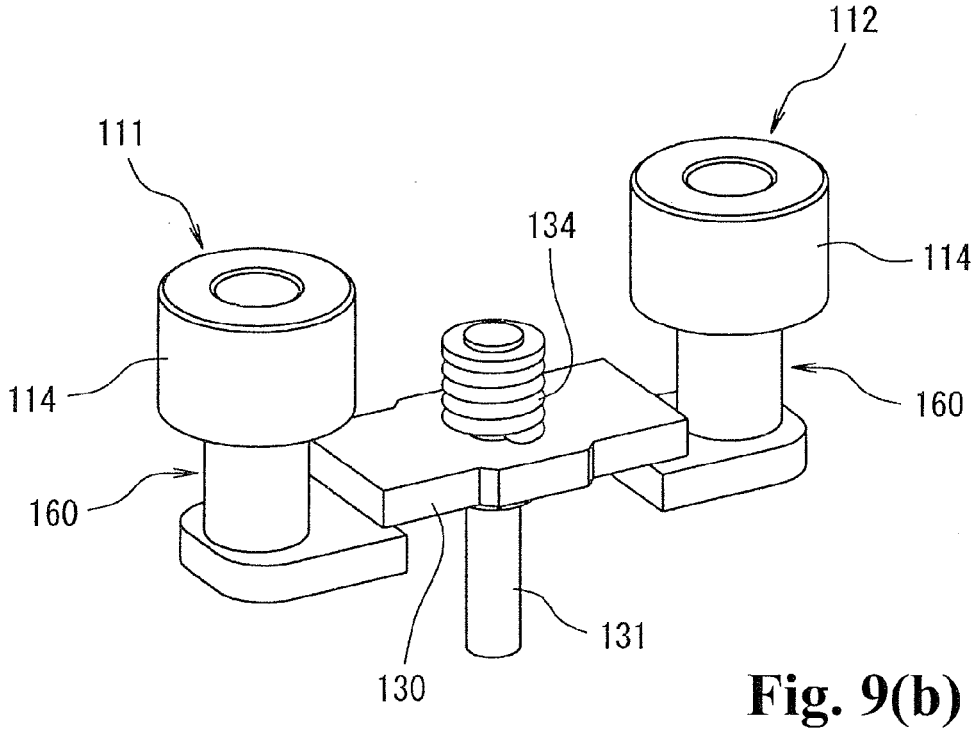

Also, in the first and second embodiments, a description has been given of a case wherein the contact conductor portion 115 is formed in the fixed contacts 111 and 112 but, not being limited to this, an L-shaped portion 160, of a form such that the upper plate portion 116 of the contact conductor portion 115 is omitted, may be connected to the support conductor portion 114, as shown in FIGS. 9(*a*) and 9(*b*).

In this case too, in the closed contact state wherein the movable contact 130 contacts the fixed contacts 111 and 112, it is possible to cause magnetic flux generated by the current flowing through a vertical plate portion of the L-shaped portion 160 to act on portions in which the fixed contacts 111 and 112 and the movable contact 130 are in contact. Because of this, it is possible to increase the magnetic flux density in the portions in which the fixed contacts 111 and 112 and the movable contact 130 are in contact, generating a Lorentz force that opposes the electromagnetic repulsion force.

Also, in the heretofore described embodiments, a description has been given of a case wherein the movable contact 130 has the depressed portion 132 in a central portion thereof but, not being limited to this, the depressed portion 132 may be omitted, forming a flat plate, as shown in FIGS. 10(*a*) and 10(*b*).

Also, in the first and second embodiments, a description has been given of a case wherein the connecting shaft 131 is screwed to the movable plunger 215, but the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but not being limited to this. That is, a positioning large diameter portion may be formed protruding in a radial direction in the C-ring position of the connecting shaft 131, the contact spring 134 disposed after the movable contact 130 contacts the large diameter portion, and the upper end of the contact spring 134 fixed with the C-ring.

Also, in the heretofore described embodiments, a description has been given of a case wherein a hermetic receptacle is configured of the contact housing case 102 and cap 230, and gas is encapsulated inside the hermetic receptacle but, this not being limiting, the gas encapsulation may be omitted when the interrupted current is small.

Reference Signs List

10 . . . Electromagnetic contactor, 11 . . . External insulating receptacle, 100 . . . Contact device, 101 . . . Contact mechanism, 102 . . . Contact housing case, 104 . . . Tubular body, 105 . . . Fixed contact support insulating substrate, 111, 112 . . . Fixed contact, 114 . . . Support conductor portion, 115 . . . contact conductor portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 130 . . . Movable contact, 130*a* . . . Contact portion, 131 . . . Connecting shaft, 132 . . . Depressed portion, 134 . . . Contact spring, 140 . . . Insulating cylinder, 141, 142 . . . Magnet housing cylinder, 143, 144 . . . Arc extinguishing permanent magnet, 145, 146 . . . Arc extinguishing space, 160 . . . L-shaped portion, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke, 301 . . . Tubular portion, 302 . . . Upper surface plate portion, 303 . . . Tub-form body, 304 . . . Connection member, 305 . . . Bottom plate portion

What is claimed is:

1. An electromagnetic contactor, comprising:

a contact device including a pair of fixed contacts spaced at a predetermined interval away from each other, each having a support conductor portion supported on an upper plate of a contact housing case, and a contact conductor portion connected to an end portion of the support conductor portion inside the contact housing case, the contact conductor portion being integrally formed in a C-shape and including a contact plate portion having at least a contact portion facing the upper plate and disposed in parallel with the upper plate, a first connecting plate portion formed in proximity to the contact portion on an outer end portion of the contact plate portion and extending toward the upper plate, and a second connecting plate portion disposed in parallel to the contact plate portion between an end portion of the first connecting plate portion on an upper plate side and the support conductor portion; and a movable contact mounted onto a connecting shaft connected to a drive portion through a contact spring on an end portion of the connecting shaft on the upper plate side, and disposed to face the contact portion of each of the pair of fixed contacts from the upper plate side;

a magnetic plate formed in a C-shape and disposed inside the first connecting plate portion to cover an inner side surface of the first connecting plate portion;

an insulating cover including an L-shaped plate portion disposed to sandwich the magnetic plate with the first connecting plate portion and to cover an inner side surface of the first connecting plate portion through the magnetic plate and an inner side surface of the second connecting plate portion, and side plate portions protruding outwardly from two side portions of the L-shaped plate portion to cover side surfaces of the first and second connecting portions, wherein the contact conductor portion is formed in the C-shape to generate a Lorentz force opposing an electromagnetic repulsion force to separate the movable contact from the pair of fixed contacts when current is supplied to the pair of fixed contacts and the movable contact.

2. The electromagnetic contactor according to claim 1, wherein the movable contact includes a depressed portion protruding toward a side opposite to the upper plate side in a portion where the movable contact contacts the contact spring.

3. The electromagnetic contactor according to claim 2, wherein the movable contact includes a through hole formed at a center portion thereof, the connecting shaft is inserted into the through hole such that the contact spring is disposed between the end portion of the connecting shaft on the upper plate side and the depressed portion of the movable contact, and the drive portion is connected to the connecting shaft at another end portion thereof.

4. The electromagnetic contactor according to claim 1, wherein the movable contact is formed in a flat plate shape parallel to the upper plate.

5. The electromagnetic contactor according to claim 1, wherein the insulating cover includes a fitting portion protruding inwardly from each of the side plate portions, and an inner side surface of the fitting portion is curved to fit each of the pair of fixed contacts.

6. The electromagnetic contactor according to claim 1, wherein the L-shaped plate portion and the side plate portions of the insulating cover are integrally formed to cover the inner side surfaces of the first and second connecting plate portions and the side surfaces of the first and second connecting portions all at once.

* * * * *

UNITED STATES PATENT AND TRADEMARK OFFICE

CERTIFICATE OF CORRECTION

PATENT NO. : 9,117,611 B2
APPLICATION NO. : 14/116226
DATED : August 25, 2015
INVENTOR(S) : Yasuhiro Naka et al.

It is certified that error appears in the above-identified patent and that said Letters Patent is hereby corrected as shown below:

Specification

Please change column 3, line 42, from "... in FIG. L" to --... in FIG. 1.--.

Please change column 3, line 43, from "... are illustrated ..." to --... are illustrations ...--.

Please change column 7, line 4, from "... function protecting ..." to --... function of protecting ...--.

Please change column 10, line 61, from "... portion 114h of ..." to --... portion 114b of ...--.

Signed and Sealed this
Ninth Day of February, 2016

Michelle K. Lee

Michelle K. Lee
*Director of the United States Patent and Trademark Office*